United States Patent [19]

Boyer et al.

[11] Patent Number: 4,576,203

[45] Date of Patent: Mar. 18, 1986

[54] PRESSURE-OPERATED ECCENTRIC SHAFT COUPLING

[75] Inventors: Kent R. Boyer, Valencia; Clyde E. Cobb, Lakeview Terrace, both of Calif.

[73] Assignee: HR Textron Inc., Valencia, Calif.

[21] Appl. No.: 610,531

[22] Filed: May 15, 1984

[51] Int. Cl.[4] ..... F15B 13/043

[52] U.S. Cl. ..... 137/625.63; 137/625.64; 403/339

[58] Field of Search ..... 137/625.62, 625.64; 403/294, 339, 340, 341; 251/291

[56] References Cited

U.S. PATENT DOCUMENTS 2,742,924 4/1956 Harter ..... 137/625.48 X 2,826,178 3/1958 Krapf ..... 137/625.63

2,928,380 3/1960 Krapf ..... 137/625.63 X 3,608,586 9/1971 Daggy ..... 137/625.65

FOREIGN PATENT DOCUMENTS 2506864 8/1976 Fed. Rep. of Germany ..... 137/625.64

*Primary Examiner*—Gerald A. Michalsky

*Attorney, Agent, or Firm*—Nilsson, Robbins, Dalgarn, Berliner, Carson & Wurst

[57] ABSTRACT

A coupling device for interconnecting a drive shaft and a driven shaft which is maintained under fluid pressure to provide a tensile preload and which is specifically adapted for utilization with hydromechanical or electrohydraulic servovalves.

9 Claims, 7 Drawing Figures

FIG. 2
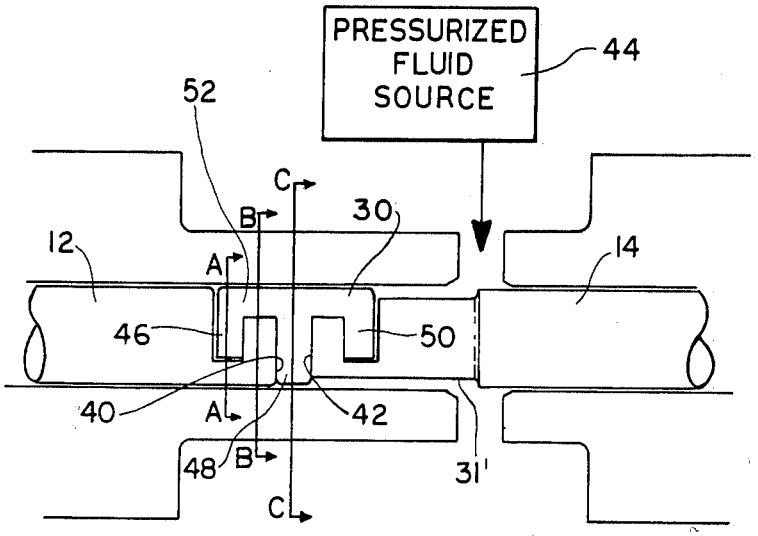
FIG. 2A
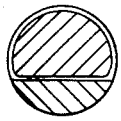
FIG. 2B
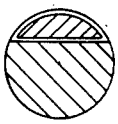
FIG. 2C
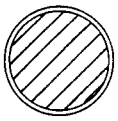
FIG. 3
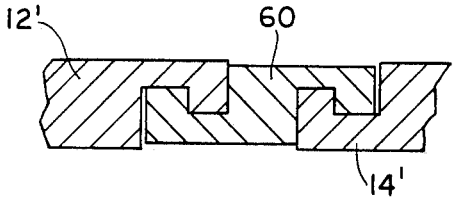
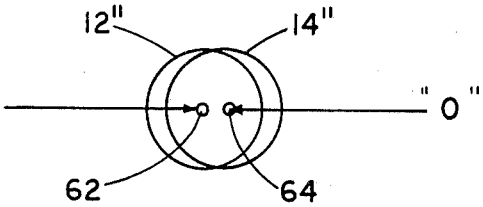
FIG. 4

PRESSURE-OPERATED ECCENTRIC SHAFT COUPLING

FIELD OF THE INVENTION

The invention relates generally to fluid flow control and more particularly to valves which include a member which is linearly reciprocally moved.

BACKGROUND OF THE INVENTION

In precision hydromechanical or electrohydraulic servovalves it is necessary to linearly reciprocate control members such as spool valves. In many instances it is necessary to mechanically couple two or more shafts together to accomplish such motion. Where the shafts are constructed of a single piece of metal or where conventional coupling devices are utilized, very strict tolerance requirements must be met in the formation of the bore receiving the valve as well as the lands upon the valve to avoid excessive operational wear, binding or the like, and a resultant reduction of the life of the valve.

As a result of the foregoing, the prior art has adopted the improvement of providing the pistons in a multiplicity of pieces which are then held together in various mechanical fashions. The best prior art known to applicant is shown in U.S. Pat. Nos. 2,742,924, 2,826,178, 2,928,380 and 3,608,586. Although the prior art operates adequately in the various applications under consideration, it has been found to be unsatisfactory in those applications where zero backlash is required.

SUMMARY OF THE INVENTION

A fluid pressure operated valve having a linearly, reciprocally, movable drive member and a driven member disposed within a cavity subjected to fluid under pressure and including a coupling means having first and second arms for insertion into first and second recesses disposed transversely of the longitudinal axis of the drive member and the driven member, respectively.

DESCRIPTION OF THE DRAWINGS

FIG. 2 is a fragmented schematic representation of a part of the apparatus shown in FIG. 1 further illustrating the coupling device of the present invention;

FIGS. 2A, 2B and 2C are cross sectional views of the coupling device of the present invention taken about the line A—A, B—B and C—C, respectively of FIG. 2;

FIG. 3 is a fragmentary cross sectional view of an alternative embodiment of a coupling apparatus constructed in accordance with the principles of the present invention; and FIG. 4 is a schematic representation illustrative of the manner in which axial offset is accommodated by the present invention.

DETAILED DESCRIPTION

Figure 1:
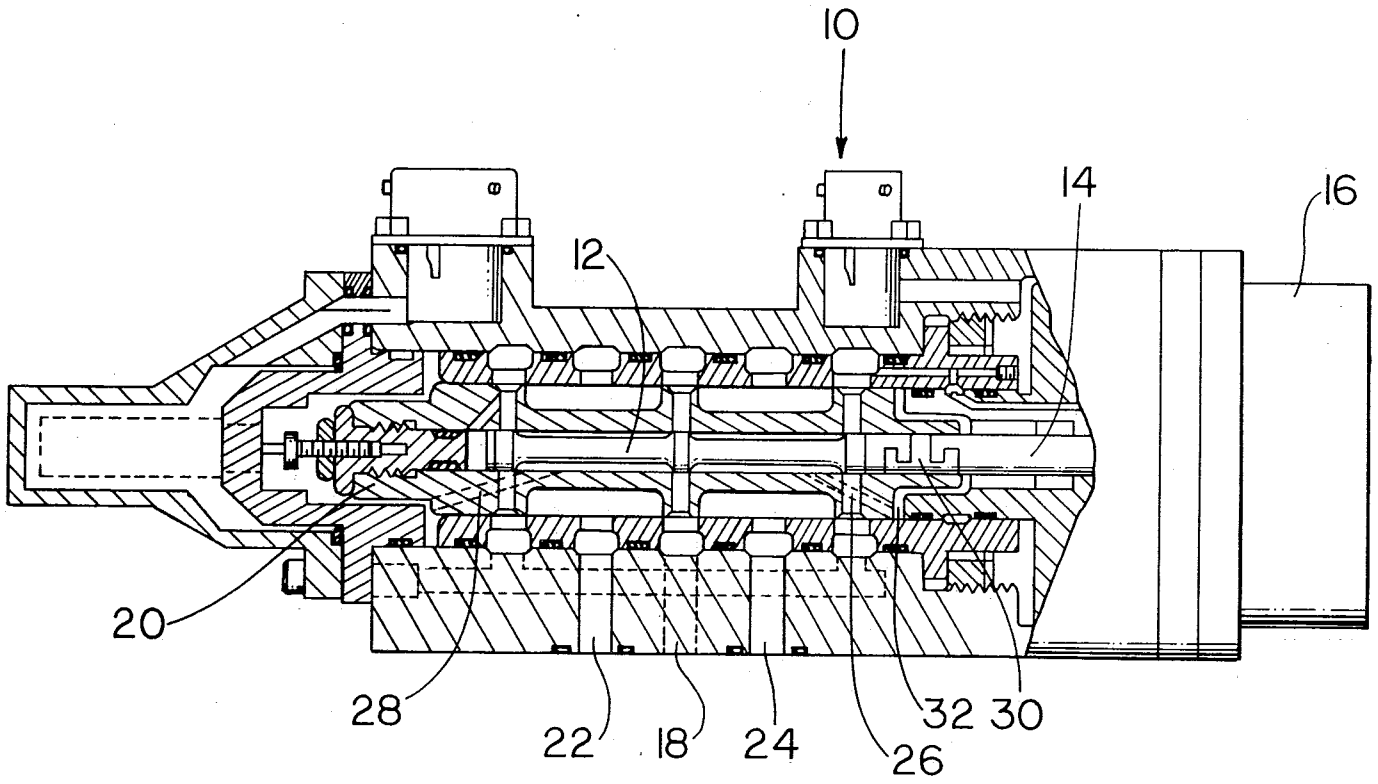
FIG. 1 is a schematic representation partly in cross section of a valve including the present invention.

As is illustrated generally at 10 in FIG. 1 there is shown a valve which includes a driven shaft 12 which is linearly, reciprocally moved by a drive shaft 14 which is part of a force motor 16. The shaft 12 in the valve shown in FIG. 1 is a pilot or control valve which controls the supply of fluid under pressure through a port 18 to position a power valve 20 which in turn controls the flow of fluid through ports 22 and 24 to a load not shown. The power valve 20 functions as a sleeve for the pilot valve 12 and as the pilot valve moves the power valve tends to follow its movements as a result of the application of pressure through the passageways 26 and 28 to the ends of the power spool 20. A coupling device 30 is provided to couple the drive shaft 14 with the driven shaft 12. A tensile preload is provided to the coupling means by application of the control pressure through the passageway 26 to a cavity 32 within which the coupling means 30 is disposed.

The device as shown in FIG. 1, as will be recognized by those skilled in the art, is a direct drive, two stage servovalve utilizing a linear force motor as the input device. As electrical signals are applied to the force motor the drive shaft 14 thereof reciprocates linearly in response thereto. The linear reciprocal movement is transmitted to the pilot stage spool valve shaft 12 in order to provide the pressure signals to move the power valve spool 20 as is known to those skilled in the art. It should be recognized by those skilled in the art that the device which couples the drive shaft and the driven shaft in accordance with the principles of the present invention may be utilized in any type of structure where the two linearly, reciprocally, movable members are coupled in an environment where fluid under pressure may be applied to preload, in tensile the coupling device. Other examples of valves operable in such a situation would be a solenoid valve, a torque motor valve or the like.

By reference now more specifically to FIG. 2, the principles of the present invention are more clearly illustrated and will become better understood.

As is illustrated in FIG. 2 the driven member in the form of shaft 12 is secured to the drive member in the form of shaft 14 by a coupling means 30. The combination of the two juxtaposed ends 40 and 42 of the shafts 12 and 14, respectively, along with the coupling means 30 are disposed within the cavity 32 which is subjected to pressure from the fluid pressure source 44. As a result, forces are generated by the pressure acting upon the ends 40 and 42 to move the shafts 12 and 14 in opposite directions, thereby loading the combination in tension.

It can be seen by reference to FIGS. 2A through 2C, as well as FIG. 2, that the coupling device 30 is a unitary member which includes three arms 46, 48 and 50 extending from a body portion 52. The arms 46 and 50 are disposed within a recess such as the groove formed in the end of the driven member 12 which includes a pair of opposed side walls and a bottom wall with the side wall adjacent the end 40 of the shaft 12 being smaller than the other side wall. Similarly, the arm 50 is disposed within a recess such as the groove which is formed in the end of the shaft 14, and which also defines a pair of opposed side walls and a bottom wall with the side wall nearest the end 42 of the shaft 14 being smaller than the other wall. The remaining arm 48 substantially fills the space which exists between the juxtaposed ends 40 and 42 of the two shafts 12 and 14. Generally, the coupling means 30 defines a "W" shape in the preferred embodiment. It can be seen that the coupling means 30 can readily and easily be inserted in place to couple the shafts 12 and 14 together.

Through the pressurization, the two shafts tend to move apart and are maintained in that position within the constraints provided by the arms 46 and 50 seated within their respective mating grooves. This tension preload permits tensile forces to be applied along the axis of the shafts without generating backlash of any type. In addition, the entire structure will withstand compressive forces applied along the axis of the shafts 12 and 14 without degradation of operation and without backlash of any type so long as the forces applied are less than the tensile preload provided by the pressure within the cavity 32 as above described.

Although the device as shown in FIG. 2 is in a generally "W" shaped cross sectional configuration, it should be understood that other shapes may be utilized. For example, as is shown in FIG. 3, the shafts 12' and 14' may be disposed so that one is turned 180 degrees as compared to the structure shown in FIG. 2 and the coupling member 60 could be formed generally "S" shaped in longitudinal cross section so that the arms depending therefrom mate with the grooves provided in the ends of the shafts 12' and 14' and the body section interconnects the two arms and again is disposed between the juxtaposed ends of the shafts 12' and 14'. By disposing the structure as shown in FIG. 3 within a pressurized cavity, the operation would be identical to that as shown in FIG. 2 and above described.

By reference now to FIG. 4 the ability of the coupling device of the present invention to accommodate axial offset or eccentricity is illustrated. As therein shown a shaft 12'' having an axis 62 is to be coupled with an additional shaft 14'' having an axis 64. The distance between the axis 62 and 64 is shown by the letter "O" indicating an offset between the axes 62 and 64 of that amount. The coupling device as shown in FIGS. 2 or 3 could be utilized so long as the diameter of the coupling means is less than the diameter of the smaller of the two shafts 12'' and 14'' by an amount which is equal to or in excess of the shaft offset or eccentricity as shown at "O".

It will be recognized by those skilled in the art that to preclude galling, if there is eccentricity between the shafts, the shaft 14 will be reduced in diameter at its end as shown at 31. Under these circumstances any offset between shafts would be accommodated. Alternatively, the cylinder walls from section line C—C to the right in FIG. 2 could be removed.

What is claimed is:

1. In a fluid pressure operated valve having a separate drive member and a separate driven member having juxtaposed ends, each of said members being reciprocally movable, the driven member controlling fluid flow responsive to signals applied to the drive member the improvement for coupling the drive and driven members comprising:

(A) a first recess having opposed side walls and a bottom wall disposed transversely of the longitudinal axis of said drive member and displaced from the end thereof;

(B) a second recess having opposed side walls and a bottom wall disposed transversely of the longitudinal axis of said driven member and displaced from the end thereof;

(C) a unitary coupler means including first and second arms for insertion into said first and second recesses;

(D) a cavity defined by said valve;

(E) a source of fluid under pressure; and (F) means connecting said cavity to said source of fluid during operation of said valve, said coupler means and the ends of said members being disposed in said cavity for placing said coupling under tensile preload to prevent backlash between said drive and driven members.

2. The improvement as defined in claim 1 wherein said drive member, said driven member and said coupler means are cylindrical and the diameter of said coupler means is less than the diameter of the ends of said members by an amount at least equal to any axial offset between said members.

3. The improvement as defined in claim 2 wherein said arms are at opposite ends of said coupler means.

4. The improvement as defined in claim 3 wherein said coupler means further includes a body portion disposed between said arms and substantially filling any space between said juxtaposed ends of said drive and driven members.

5. The improvement as defined in claim 4 wherein said first and second recesses are each defined by a groove, the depth of each of said grooves being greater than the radius of its respective members.

6. The improvement as defined in claim 5 wherein said coupler means is "W" shaped in longitudinal cross section.

7. The improvement as defined in claim 6 wherein said grooves extend totally across said members and the groove side wall adjacent the end of each member is smaller in height than the other side wall thereof.

8. The improvement as defined in claim 5 wherein said coupler means is "S" shaped in longitudinal cross section.

9. The improvement as defined in claim 8 wherein said grooves extend totally across said members and the groove side wall adjacent the end of each member is smaller in height than the other side wall thereof.

* * * * *